US006164667A

United States Patent [19]

Olivieri

[11] Patent Number: 6,164,667

[45] Date of Patent: Dec. 26, 2000

[54] SKATE BLADE AND SKATE BLADE ASSEMBLY

[75] Inventor: Icaro Olivieri, Westmount, Canada

[73] Assignee: Bauer Nike Hockey Inc., Canada

[21] Appl. No.: 09/364,087

[22] Filed: Jul. 30, 1999

Related U.S. Application Data

[63] Continuation of application No. 08/817,651, Apr. 9, 1997, which is a continuation-in-part of application No. 08/332,797, Nov. 2, 1994, abandoned, which is a continuation-in-part of application No. 08/260,375, Jun. 14, 1994, Pat. No. 5,484,148.

[51] Int. Cl.[7] ..... A63C 1/30

[52] U.S. Cl. ..... 280/11.18; 280/11.12

[58] Field of Search ..... 280/11.12, 11.18, 280/11.14, 11.15, 11.17

[56] References Cited

U.S. PATENT DOCUMENTS

| | | | |
|---|---|---|---|
| 57,335 | 8/1866 | Kinzer | 280/11.12 |
| 475,650 | 5/1892 | Wierda | 280/11.12 |
| 2,414,967 | 1/1947 | Meyers | 280/11.18 X |
| 2,523,052 | 9/1950 | Normandin | 280/28 |
| 3,120,963 | 2/1964 | Seckel | 280/28 |
| 3,212,786 | 10/1965 | Florjanic et al. | 280/11.12 |
| 3,954,278 | 5/1976 | McLeod | 280/11.12 X |
| 4,074,909 | 2/1978 | Baikie | 280/11.12 |
| 4,549,742 | 10/1985 | Husak et al. | 280/11.18 |

FOREIGN PATENT DOCUMENTS

| | | | |
|---|---|---|---|
| 1325819 | 1/1994 | Canada . | |
| 514214 | 11/1939 | United Kingdom | 280/11.18 |

OTHER PUBLICATIONS

International Search Report, Sep. 29, 1995.

*Primary Examiner*—Michael Mar
*Assistant Examiner*—Pamela J. Lipka
*Attorney, Agent, or Firm*—Finnegan, Henderson, Farabow, Garrett & Dunner, LLP

[57] ABSTRACT

A rigid reinforcement member extends longitudinally along the neck portion of the skate blade holder, to reduce stress and improve force transfer. The blade holder has a longitudinal slot running along the bottom thereof to receive a blade or runner, which is secured in the slot. At least one rigid reinforcement member runs along at last the neck portion, within the slot and above the runner, the slot being enlarged at the location of the reinforcement member(s) in order to accommodate the member(s). Preferably, the reinforcement member is in one piece, including an upper web portion and an integral channel with a cross section in the form of inverted U-shape beneath the upper web portion. The arms of U-shape run alongside the runner, one on either side of the runner, and the base of the U-shape lies against the top of the runner and follows the shape thereof. Preferably, the rigid reinforcement member is of a reinforced plastic composite material, although a metal could also be used. The increased rigidity of the blade holder permits the use of a lighter runner, which may be provided by using a runner with a number of cut-out areas. The cutouts are arranged in a central area between a solid upper area of the runner and a solid lower area of the runner, in such a fashion that the remaining metal in the central area leaves a truss-like structure between the upper and lower areas, the truss-like structure serving to retain most of the rigidity of the runner.

11 Claims, 7 Drawing Sheets

SKATE BLADE AND SKATE BLADE ASSEMBLY

This Appln is a con't of Ser. No. 08/817,651 filed Apr. 9, 1997, which is a C-I-P of Ser. No. 08/332,797 filed Nov. 2, 1994, Abnd. which is a C-I-P of Ser. No. 08/260,375 filed Jun. 14, 1994 U.S. Pat. No. 5,484,148.

TECHNICAL FIELD

This invention relates to ice skates, and in particular to an improved skate blade and skate blade support.

BACKGROUND ART

In conventional skate blade assemblies such as those manufactured and sold by Canstar Sports Inc. under its TUUK trademark, a blade holder, which is secured to the skate boot, has a longitudinal slot into which the blade or "runner" is installed.

This blade assembly has been extremely successful. However, in the constant quest for improvement, it was determined that it would be desirable to provide greater rigidity along the central portion of the blade holder, i.e. along the neck portion between the heel and toe portions, since this greater rigidity would permit the use of a less rigid blade or runner, which would permit the overall weight of the skate to be reduced. This greater rigidity would also reduce the stress on the neck portion of the blade holder, which is desirable because the plastic of the blade holder is more brittle when under stress. Reinforcement would also provide better force transfer between the ice and the skate boot, via the attachments between the boot and the front and rear portions of the blade holder.

Reduced weight in skates, without sacrificing performance, is an ongoing goal in the industry. Generally, reducing the weight of the skate blade itself has not been considered to be a viable option, since it was assumed that this would reduce the required stiffness to an undesirable degree.

DISCLOSURE OF INVENTION

In view of the foregoing, one aspect of the invention provides a rigid reinforcement member extending longitudinally along the at least the neck portion of the blade holder, to reduce stress and improve force transfer.

More particularly, the skate blade assembly of the first aspect of the invention has an elongated blade holder having a front portion for attachment beneath the toe area of the skate boot, a rear portion for attachment beneath the heel area of the skate boot, and an integral neck portion between the front and rear portions. The blade holder has a longitudinal slot running along the bottom thereof to receive a blade or "runner", which is secured in the slot. At least one rigid reinforcement member runs along at least the neck portion, within the slot and above the runner, the slot being enlarged at the location of the reinforcement member(s) in order to accommodate the member(s).

Preferably, the reinforcement member is in one piece, including an upper web portion and an integral channel with a cross-section in the form of inverted U-shape beneath the upper web portion. The arms of the U-shape run alongside the runner, one on either side of the runner, and the base of the U-shape lies against the top of the runner and follows the shape thereof.

Preferably, the rigid reinforcement member is of a reinforced plastic composite material, although a metal could also be used.

The useful nature of the reinforced blade holder was verified in testing. It was determined that the blade or runner could be reduced in weight accordingly, by providing it with a plurality of suitably-configured cutout areas. A second aspect of the invention, therefore, relates to a skate and skate blade assembly where the runner has a plurality of cutouts, spaced longitudinally along the runner, thereby reducing the weight of the runner significantly, i.e. typically by about 41 grams. That is a significant weight reduction, representing about a 30 percent reduction in the weight of the runner, and about a 4 percent reduction in the overall weight of the skate.

The cutouts preferably are arranged in a central area between a solid upper area of the runner and a solid lower area of the runner, extending a substantial portion of the overall length of the runner, in such a fashion that the remaining metal in the central area leaves a truss-like structure between the upper and lower areas, the truss-like structure serving to retain most of the rigidity of the runner.

Upon closer examination, it was realized that the runner with the suitably-configured cutouts was not significantly less stiff than a conventional solid runner, so that it could be used without necessarily using the reinforced blade holder aspect of the invention. Of course, it was also realized that the reinforced blade holder could be used without necessarily using a runner with cutouts, although the optimum blade assembly has the reinforcement, and uses the runner with cutouts.

Further features of the invention will be described or will become apparent in the course of the following detailed description, or from an examination of the accompanying drawings.

BRIEF DESCRIPTION OF DRAWINGS

The invention will be better understood from the ensuing detailed description of the preferred embodiment, by way of example only. Reference will be made to the accompanying drawings, in which.

BEST MODE FOR CARRYING OUT THE INVENTION

Figure 1:
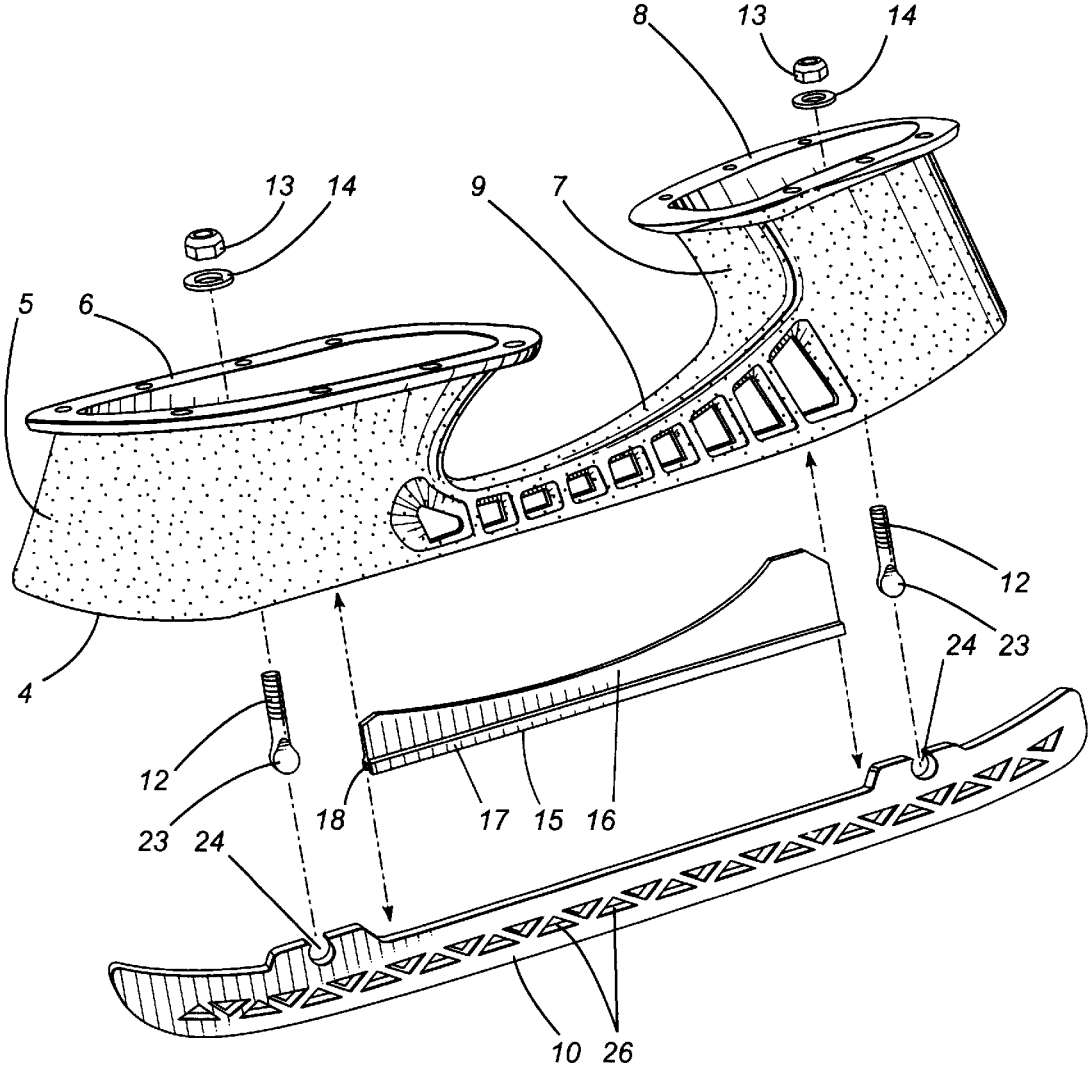
FIG. 1 is an exploded perspective view of the blade assembly, showing a conventional blade holder and runner, with the reinforcement insert of the first aspect of the invention.
Figure 2:
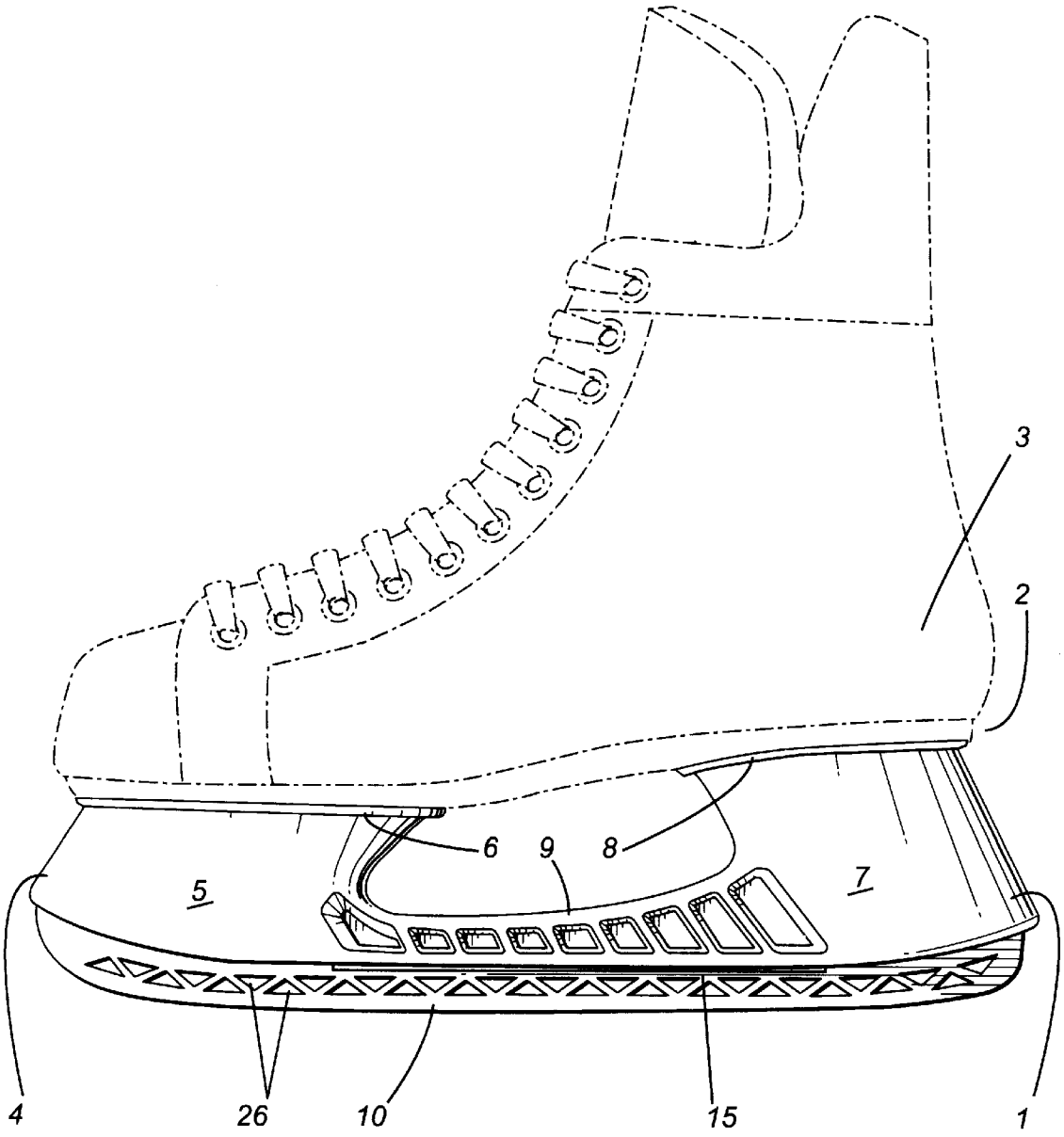
FIG. 2 is a side view of the assembled blade assembly, with a skate boot shown in phantom lines.
Figure 3:
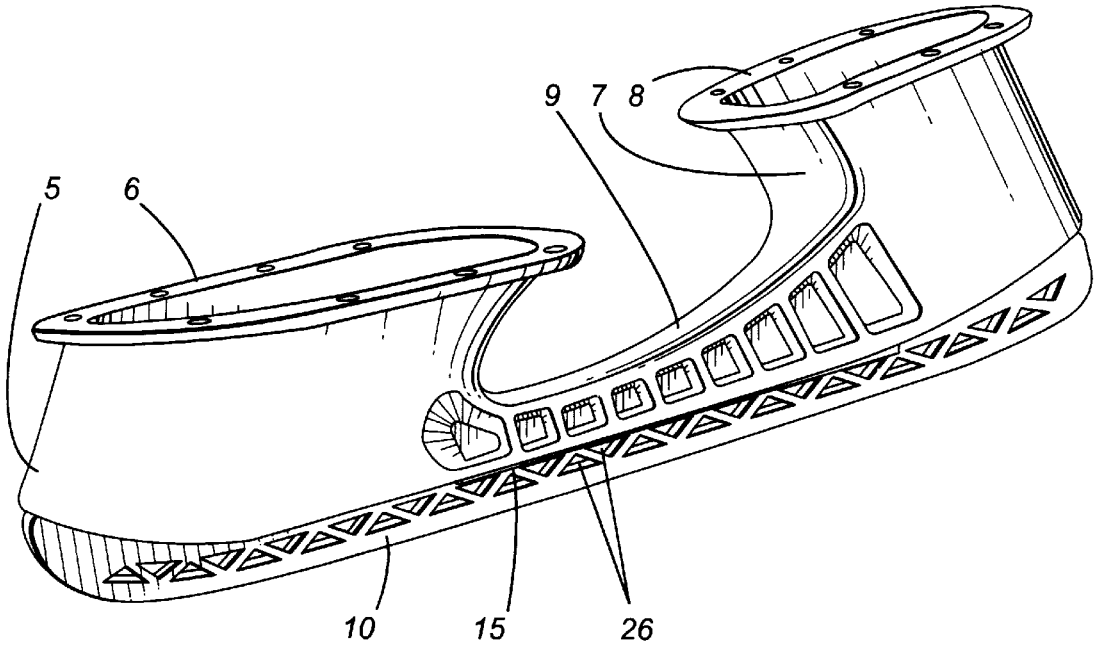
FIG. 3 is a side perspective view of the assembled blade assembly.
Figure 4:
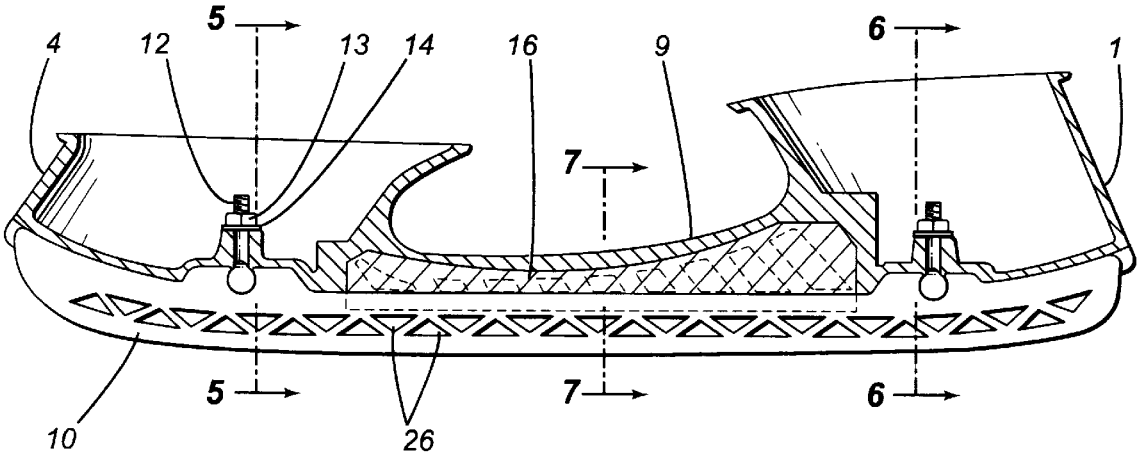
FIG. 4 is a side cross-sectional view of the assembled blade assembly.
Figure 5:
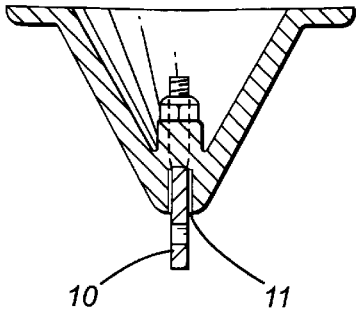
FIG. 5 is a cross-section of the blade assembly at 5—5 in FIG. 4.
Figure 6:
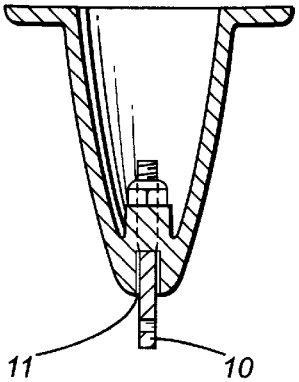
FIG. 6 is a cross-section of the blade assembly at 6—6 in FIG. 4.
Figure 7:
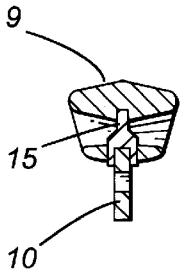
FIG. 7 is a cross-section of the blade assembly at 7—7 in FIG. 4.
Figure 8:
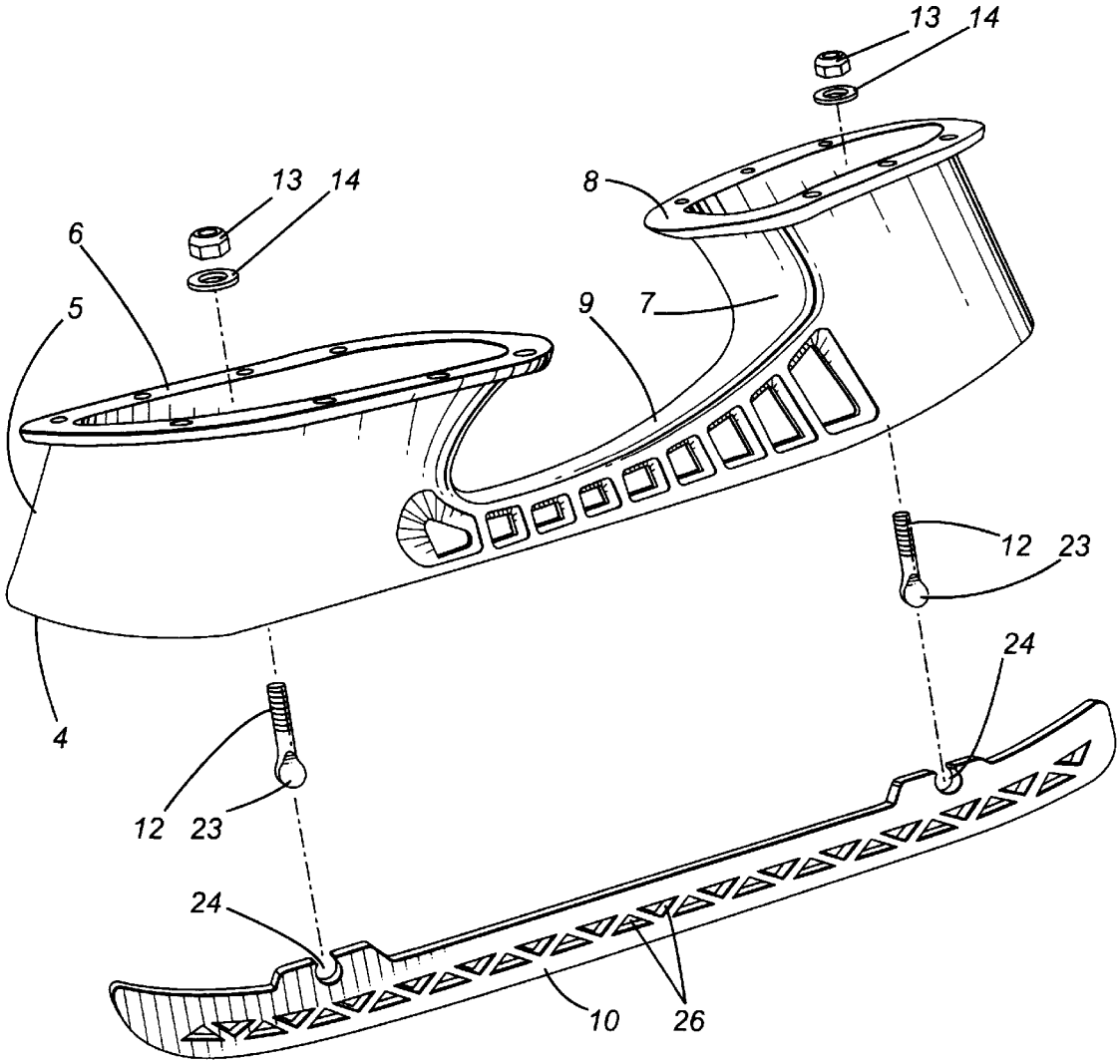
FIG. 8 is an exploded perspective view of the blade assembly, showing a conventional blade holder and runner, with a blade or runner which is provided with suitably-configured cutout areas.
Figure 9:
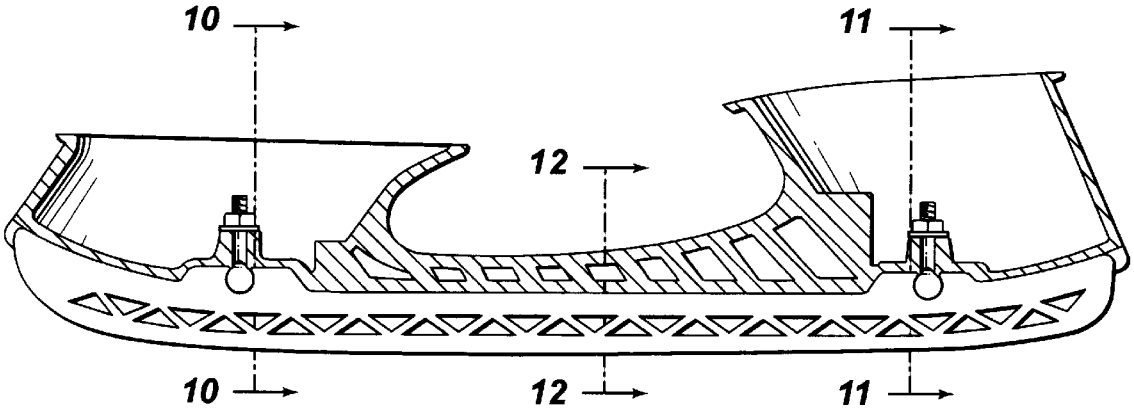
FIG. 9 is a side cross-sectional view of the assembled blade assembly of FIG. 8.
Figure 10:
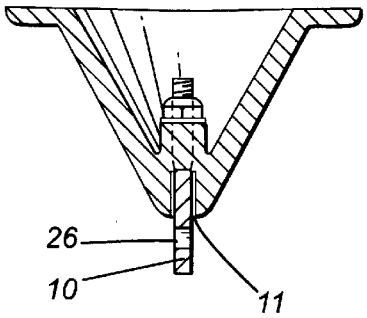
FIG. 10 is a cross-section of the blade assembly at 10—10 in FIG. 9.
Figure 11:
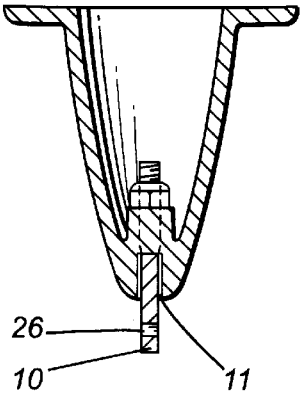
FIG. 11 is a cross-section of the blade assembly at 11—11 in FIG. 9.
Figure 12:
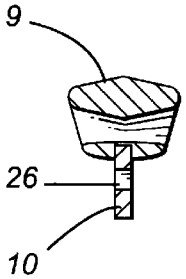
FIG. 12 is a cross-section of the blade assembly at 12—12 in FIG. 9.

Referring to the accompanying drawings, the skate blade assembly 1 is part of a typical skate 2, which also includes a boot 3. The blade assembly includes an elongated blade holder 4 having a front portion 5 with a front pad 6 for attachment beneath the toe area of the boot, a rear portion 7 with a rear pad 8 for attachment beneath the heel area of the skate boot, and an integral neck portion 9 between the front and rear portions. A blade or "runner" 10 is secured in a longitudinal slot 11 running along the bottom of the blade holder, by pins 12 which are pulled upwardly by nuts 13 which contact collars 14. The pins have rounded, flattened heads 23 which fit into appropriately dimensioned rounded slots 24 in the runner.

In the first aspect of the invention, at least one rigid reinforcement member 15 runs along at least the neck portion, within the slot and above the runner, the slot being enlarged at the location of the reinforcement member(s) in order to accommodate the member(s). Conceivably, there could be more than one such member. There could be two such members, for example, one on either side of the runner.

Preferably, though, the reinforcement member is in one piece, including an upper web portion 16 and an integral channel 17 with a cross-section in the form of inverted U-shape beneath the upper web portion. The arms of the U-shape run alongside the runner, one on either side of the runner, and the base of the U-shape lies against the top of the runner and follows the shape thereof, the runner being accommodated within the slot 18.

It is an advantage of the invention that the reinforced blade holder allows the runner itself to be slightly less rigid. The runner therefore can be reduced in weight, for example by a plurality of cutouts 26. This reduces the overall weight of the blade assembly as well, since more weight is removed from the runner than is added by the reinforcement member.

Preferably, the rigid reinforcement member is of a reinforced plastic composite material, such as an epoxy/graphite fiber mix, although a metal could also be used.

The reinforcement member provides the desired greater rigidity along the neck portion of the blade holder, thereby reducing the stress on the blade holder. As mentioned previously, this is desirable because the plastic of the blade holder, typically of Zytel (trademark) nylon, is more brittle when under stress. The reinforcement member reduces the stress, and also provides better force transfer between the ice and the skate boot, via the attachments at the front and rear pads between the boot and the blade holder.

The first aspect of the invention has been described with particular reference to a preferred embodiment. Various modifications can be made, of course, without departing from the spirit of the invention, and such modifications are intended to be within the scope of the following claims whether or not expressly described in the above text or illustrated in the accompanying drawings.

As one example of such modifications, it should be readily apparent that the reinforcement insert could extend for the whole length or substantially the whole length of the blade holder, not just along the neck portion.

The second aspect of the invention relates to the runner being reduced in weight relative to conventional solid runners, by virtue of the cutouts 26.

The cutouts are arranged in a central area between a solid upper area 28 of the runner and a solid lower area 30 of the runner, extending a substantial portion of the overall length of the runner, in such a fashion that the remaining metal in the central area leaves a truss-like structure between the upper and lower areas, the truss-like structure serving to retain most of the rigidity of the runner.

In the preferred embodiment of this second aspect, the cutouts are triangular, each successive triangle being inverted relative to its predecessor, so that there are ribs 32 between the cutouts, each successive rib angling in an opposite direction, i.e. one forwardly and the nest one rearwardly.

Figure 13:
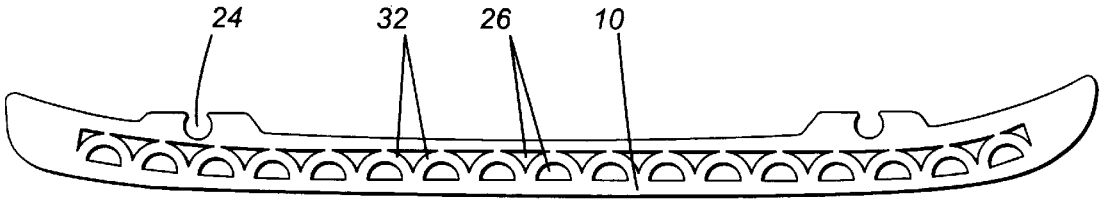
FIG. 13 is a side view of an alternative embodiment of the runner.

An alternative is shown in FIG. 13, in which successive semi-circular cutouts of the same orientation could have curved triangular cutouts between them, in effect leaving curved ribs 32, themselves having a semi-circular look. Other similar shapes are clearly conceivable.

It should be clear that although the optimum blade assembly has the reinforcement, and uses the runner with cutouts, the reinforcement in itself is advantageous, and can be used without the cutouts, although the advantages of reduced weight may not be realized. Similarly, the cutouts may be used with the reinforcement, although increased stiffness may then not be realized.

The invention has been described with particular reference to preferred and alternative embodiments. Various modifications can be made, of course, without departing from the spirit of the invention, and such modifications are intended to be within the scope of the following claims whether or not expressly described in the above text or illustrated in the accompanying drawings.

Industrial Applicability

The invention provides an improved ice skate blade and ice skate blade assembly.

What is claimed is:

1. An ice skate blade comprising a plurality of cut-out areas space longitudinally therealong to reduce the weight of said blade, said cut-out areas being arranged in a central area between a solid upper area of said blade and a solid lower area of said blade and extending a substantial portion of the overall length of said blade and being generally semi-circular and having the same orientation and wherein an inverted curved generally triangular cut-out area is located in between two said successive semi-circular cut-out areas.

2. A blade as defined in claim 1, wherein the weight is reduced by about 30%.

3. An ice skate blade assembly for attachment to a skate boot, said ice skate blade assembly comprising:

(a) an elongated blade holder having a top portion for attachment to the skate boot and a bottom portion comprising a longitudinal slot for receiving a reinforcement member and an ice skate blade, said blade holder further comprising a front portion for attachment beneath a toe area of the skate boot, a rear portion for attachment beneath a heel area of the skate boot and an integral neck portion between said front and rear portions wherein said neck portion receives a reinforcement member;

(b) a rigid reinforcement member secured within said longitudinal slot, said reinforcement member comprising a channel portion for receiving an ice skate blade, said reinforcement member being secured within said longitudinal slot of said blade holder; and;

(c) an ice skate blade secured within said channel portion of said reinforcement member and within said longitudinal slot of said blade support, said ice skate blade comprising a plurality of cut-out areas spaced longitudinally therealong to reduce the weight of said blade, said cut-out areas being arranged in a central area between a solid upper area of said blade and a solid lower area of said blade and extending a substantial portion of the overall length of said blade and being generally semi-circular and having the same orientation and wherein an inverted curved generally triangular cut-out area is located in between two said successive semi-circular cut-out areas.

4. An ice skate blade assembly for attachment to a skate boot, said ice skate blade assembly comprising:

a) an elongated blade holder having front and rear pedestals with respective top portions for attachment to the skate boot and a bridge portion connecting said front and rear pedestals, said blade holder further having a bottom portion comprising a longitudinal slot; and b) an ice skate blade secured within said slot, said blade comprising a plurality of cut-out areas spaced longitudinally along the overall length of said blade for defining a truss-like structure that allows retaining most of the rigidity of said blade while substantially reducing its weight, said cut-out areas being located below said blade holder when said blade is secured within said slot, and said cut-out areas being triangular and wherein each successive triangular cut-out is inverted relative to its predecessor thereby defining ribs between the cut-outs, each successive rib angling forwardly or rearwardly in alternating fashion.

5. An ice skate blade assembly as defined in claim 4, wherein the weight of said blade is reduced by about 30%.

6. An ice skate blade assembly as defined in claim 4, wherein said cut-out areas are arranged in a central area between a solid upper area of said blade and a solid lower area of said blade.

7. An ice skate blade assembly as defined in claim 4, wherein said cut-out areas are arranged in substantially continuous alignment along the length of said blade.

8. An ice skate comprising a skate boot and an ice skate blade assembly for attachment to a skate boot, said ice skate blade assembly comprising:

a) an elongated blade holder having front and rear pedestals with respective top portions for attachment to the skate boot and a bridge portion connecting said front and rear pedestals, said blade holder further having a bottom portion comprising a longitudinal slot, and b) an ice skate blade secured within said slot, said blade comprising a plurality of cut-out areas spaced longitudinally along the overall length of said blade for defining a truss-like structure that allows retaining most of the rigidity of said blade while substantially reducing its weight, said cut-out areas being located below said blade holder when said blade is secured within said slot, and said cut-out areas are triangular and wherein each successive triangular cut-out is inverted relative to its predecessor thereby defining ribs between the cut-outs, each successive rib angling forwardly or rearwardly in alternating fashion.

9. An ice skate as defined in claim 8, wherein the weight of said blade is reduced by about 30%.

10. An ice skate as defined in claim 8, wherein said cut-out areas are arranged in a central area between a solid upper area of said blade and a solid lower area of said blade.

11. An ice skate as defined in claim 8, wherein said cut-out areas are arranged in substantially continuous alignment along the length of said blade.

* * * * *

UNITED STATES PATENT AND TRADEMARK OFFICE

CERTIFICATE OF CORRECTION

PATENT NO. 6,164,667

DATED: December 26, 2000

INVENTORS: Icaro Olivieri

It is hereby certified that errors appear in the above-identified patent and that said Letters Patent is hereby corrected as shown below:

Title Page, item [57] (Abstract), line 6, "at last" should read -- at least--.

Claim 1, Col. 4, line 37, "space" should read --spaced--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*